United States Patent [19]

Murakami et al.

[11] Patent Number: 4,840,116

[45] Date of Patent: Jun. 20, 1989

[54] CONTROLLING METHOD FOR OPERATION OF PAINTING BOOTH

[75] Inventors: Akihiro Murakami; Mitsunobu Matsunaga; Yasunari Tanemura, all of Toyota, Japan

[73] Assignee: Toyota Jidosha Kabushiki Kaisha, Aichi, Japan

[21] Appl. No.: 135,381

[22] Filed: Dec. 21, 1987

[30] Foreign Application Priority Data

Jan. 10, 1987 [JP] Japan ..... 62-3693

[51] Int. Cl.[4] ..... B05C 15/00

[52] U.S. Cl. ..... 98/115.2

[58] Field of Search ..... 98/115.1, 115.2; 118/326

[56] References Cited

U.S. PATENT DOCUMENTS

| | | | |
|---|---|---|---|
| 4,261,256 | 4/1981 | Joret | 98/115.2 |
| 4,313,369 | 2/1982 | Tsuruta et al. | 98/115.2 |
| 4,653,387 | 3/1987 | Ojawa et al. | 98/115.2 |
| 4,729,294 | 3/1988 | Ojawa et al. | 98/115.2 |

FOREIGN PATENT DOCUMENTS

| | | | |
|---|---|---|---|
| 26359 | 4/1981 | European Pat. Off. | 98/115.2 |
| 165062 | 9/1982 | Japan . | |

*Primary Examiner*—Harold Joyce

*Attorney, Agent, or Firm*—Finnegan, Henderson, Farabow, Garrett, and Dunner

[57] ABSTRACT

A controlling method for operation of painting booth wherein an air inlet chamber and an exhaust chamber are provided at upper portion and lower portion of a tunnel-like painting chamber respectively, these painting chamber, air inlet chamber and exhaust chamber are divided into a plurality of zones longitudinally, each zone is connected to independent feed air and exhaust systems, which comprises detecting an air-speed value of a horizontal air current in each zone, adjusting a feed air quantity or an exhaust quantity in the two adjacent zones so as to keep the air-speed value within a predetermined range, enabling operation for start-up and shutdown successively or steady operation without causing the horizontal air current to bring about a defective painting.

7 Claims, 11 Drawing Sheets

CONTROLLING METHOD FOR OPERATION OF PAINTING BOOTH

BACKGROUND OF THE INVENTION

1. Field of the Invention

The present invention relates to a controlling method for operation of a painting booth wherein objects carried continuously therethrough are painted.

2. Description of the Prior Art

For spraying a paint on a body of cars, for example, the prior art comprises an elongated painting booth having a tunnel-like painting chamber, wherein a conveyor for carrying the body thereon is laid, and a plurality of painting machines are disposed in the direction of conveyance, thereby spraying a paint on the body flowing on the conveyor at regular intervals through the painting machines properly selected therefor.

In such a continuous painting, however, it is essential for enhancing a paint quality that a paint mist arising from spray and an evaporating organic solvent be removed quickly from within the painting chamber, and thus the painting booth is structured generally such that the painting chamber is provided with an air inlet chamber and an exhaust chamber at upper portion and lower portion respectively, thereby generating a vertical current of a conditioned air within the painting chamber. In such painting booth, the aforementioned paint mist and evaporating organic solvent are quickly discharged outside the painting chamber on the vertical air current, and the painting chamber is kept at a constant atmosphere inside.

However, a large-sized painting booth may range 90m or over in full length, and in all such large-sized booths, the problem is such that it is very difficult to control the atmosphere in the painting chamber uniformly. Such being the circumstances, there developed recently is a painting booth to a practical service which is constructed to have the painting chamber divided inside into a plural zone longitudinally, independent air inlet and exhaust systems being connected to each zone to a fine control of the atmosphere.

Meanwhile, in the case of large-sized painting booth divided into a plurality of zones as mentioned above, there appears a zone where the object to be painted is not present, or such a zone as is not concerned in painting for a while after the operation starts or before the operation is over. Accordingly, an advantageous operation may be secured in the point particularly of energy saving from an arrangement wherein air inlet and exhaust systems of each zone will be actuated or shut down independently according to a state where the object to be painted is carried, that is. air inlet and exhaust systems will be actuated successively from a zone wherein the object to be painted arrives and shut down successively from a zone wherein the object to be painted is not present. However, in the aforementioned painting booth prevailing hitherto, if air inlet and exhaust systems are actuated or shut down per zone, a horizontal air current is generated in the painting booth, and thus a defective painting may result from the paint mist sticking on the surface of the object to be painted in a zone where the painting is under way.

Now, therefore, according to Japanese Patent Laid-Open No. 165062/1982, the painting booth itself is subjected to improvement, thereby ensuring an operating method so as not to generate a horizontal air current. The painting booth is shaped like a tunnel, as shown in FIG. 1, with air inlet chambers 1*a*, 1*b* and exhaust chambers 2*a*, 2*b* formed at upper and lower portions respectively. Dividers 4, 4, 4 are formed from the air inlet chambers 1*a*, 1*b* toward the exhaust chambers 2*a*, 2*b* in a painting chamber 3 and also at accesses vertically, and closable doors 6*a*, 6*b*, 6*c* are at every dividers 4 so as to allow a car body 5 as an object to be painted to pass therethrough. Then, air conditioners 8*a*, 8*b* are mounted for the air inlet chambers 1*a*, 1*b* through blast fans 7*a*, 7*b*, exhaust fans 9*a*, 9*b* are mounted for the exhaust chambers 2*a*, 2*b*, and further damper like pressure regulators 10*a*, 10*b* for regulating internal pressures are mounted on an inside wall of the painting chamber 3.

Thus, when the painting chamber 3 is started for operation, first the doors 6*a*, 6*b*, 6*c* are kept close, the blast fan 7*a* and the exhaust fan 9*a* are actuated, and also the pressure regulator 10*a* is actuated, thereby generating a vertical air current in a zone A. The door 6*a* is opened in the stage where the car body 5 comes near to the zone A, and thus the car body 5 is allowed to come into the zone A to painting. Then in the stage where painting on the car body 5 properly goes in the zone A, the blast fan 7*b* and the exhaust fan 9*b* are actuated, and also the pressure regulator 10*b* is actuated, thereby generating a vertical air current in a zone B. Then in the stage where the car body 5 comes near to the zone B, the doors 6*b*, 6*c* are opened, the car body 5 is thus allowed to come into the zone B to painting. After the painting in the zone B is over, the car body 5 is carried outside the painting chamber 3, and then car bodies on the second and thereafter are subjected to painting with all the doors 6*a*, 6*b*, 6*c* kept open.

At the time when the painting booth is stopped for operation, the doors 6*a*, 6*b* are closed in the stage where the final car body 5 leaves the zone A, and the blast fan 7*a* and the exhaust fan 9*a* are shut down at the same time. Then in the stage where the final car body 5 leaves the zone B, the door 6*c* is closed and the blast fan 7*b* and the exhaust fan 9*b* are shut down.

However, according to the method disclosed in the aforementioned Japanese Patent Laid-Open No. 165062/1982, it is difficult practically to find a time to operate the doors 6*a*, 6*b*, 6*c*, and numerous parts are required to complicate the structure.

On the other hand, in the large-sized painting booth divided into a plurality of zones as described, the problem is such that a defective painting is easy to arise among objects to be painted even in a steady operating state free from the aforementioned sequential start-up and shutdown. Upon closer examination by the inventors, it has been clarified that there is generated a horizontal air current in both the zones A, B other than the vertical air current, and the combined air current flows slantwise to scatter the paint mist. To prevent the defective painting, the horizontal air current must be kept from arising, however, in the prior art painting booth, merely a feed air quantity is adjusted, and a measure for restraining the horizontal air current is not particularly taken, therefore the aforementioned defect cannot be avoided.

SUMMARY OF THE INVENTION

A first object of the invention is to provide a secure method for controlling operation of a painting booth, whereby a horizontal air current can be restrained from arising at the time of operation for sequential start-up and shutdown, and a second object of the invention is to provide a secure method for controlling operation of a painting booth, whereby a horizontal air current can be restrained from arising at the time of steady operation.

In order to attain the first object, the invention is characterized in that a vertical air current is generated by actuating a blast fan and an exhaust fan for the fore zone of those which are so divided in a painting chamber with an air inlet chamber and an exhaust chamber opposite to each other, then the exhaust quantity is increased by actuating a blast fan and an exhaust fan for the rear zone continuing to the fore zone according to the position of an object to be painted in the fore zone, a feed air quantity of the rear zone is controlled according to the speed of a horizontal air current of the fore zone, and when the exhaust of the rear zone reaches a predetermined quantity, a generation of the air current of the rear zone is set by making the feed air quantity of the rear zone constant;

on the other hand, an exhaust quantity of the fore zone is decreased according to the position of an object to be painted in the rear zone of those which are so divided, a feed air quantity of the fore zone is controlled according to the speed of a horizontal air current of the rear zone, and when an exhaust quantity of the fore zone becomes zero, the air current of the fore zone is stopped by making the feed air quantity of the fore zone constant.

According to the aforementioned method for controlling operation of a painting booth, an object to be painted is subjected to painting in the booth, and since a horizontal air current is not generated in each zone, each object in painting will never be coated with a paint mist. Further, an air inlet and an exhaust for generating an air current successively can be actuated and shut down from the fore zone to the rear zone.

In the above-described invention, it is desirable that the acceleration or deceleration be controlled for adjusting a feed air quantity. A response efficiency can be enhanced by controlling the acceleration or deceleration, thus enhancing control efficiency.

Further in the invention described above, it is desirable that acceleration or deceleration of feed air and exhaust quantities be controlled equally by each blast fan and exhaust fan for adjusting the feed air and exhaust quantities of each zone by a plurality of blast fans and exhaust fans. In this case, a disturbance of the air current due to dispersion in capacity of each blast fan and exhaust fan can be suppressed, thus stabilizing control function.

In order to attain the second object, the invention is characterized further in that in a painting booth wherein an air inlet chamber and an exhaust chamber are provided at upper portion and lower portion of a tunnel-like painting chamber respectively, these painting chamber, air inlet chamber and exhaust chamber are divided into a plurality of zones longitudinally, each zone is connected to feed air and exhaust systems driven independently, the construction is improved such that an air-speed sensor for detecting air-speed values of a vertical air current and a horizontal air current is disposed in each zone of the painting chamber, the zone in which a mixed flow will be maximized is selected according to the air-speed value obtained on the air-speed sensor and as grasping how the wind blows in the zone, the exhaust system of the particular zone is controlled, a control of the exhaust system is then shifted to the other adjacent zone according to a horizontal air-speed value thereafter, the control is repeated between the zones until the horizontal air-speed value of each zone becomes a set point or below.

In the above-constructed painting booth, since the air-speed sensor for detecting air-speed values of a vertical air current and a horizontal air current is disposed in each zone, a horizontal flow which may cause the mixed flow can be traced to a zone on real time. Further, based on the result obtained through detection, a zone in which the mixed flow is maximized is selected, and by controlling an air current of the zone, not only a cause most influential for the mixed flow can quickly be removed, but also whether or not the cause for mixed flow is traced to the other zone can be securely grasped.

Further, controlling the exhaust system is to remove a horizontal flow simply according to the direction of the wind, thus sharply enhancing control efficiency, and repeating control between the zones is to control an air current without increasing a horizontal flow of the other zone, thus enhancing control precision.

DETAILED DESCRIPTION OF THE INVENTION

Figure 1:
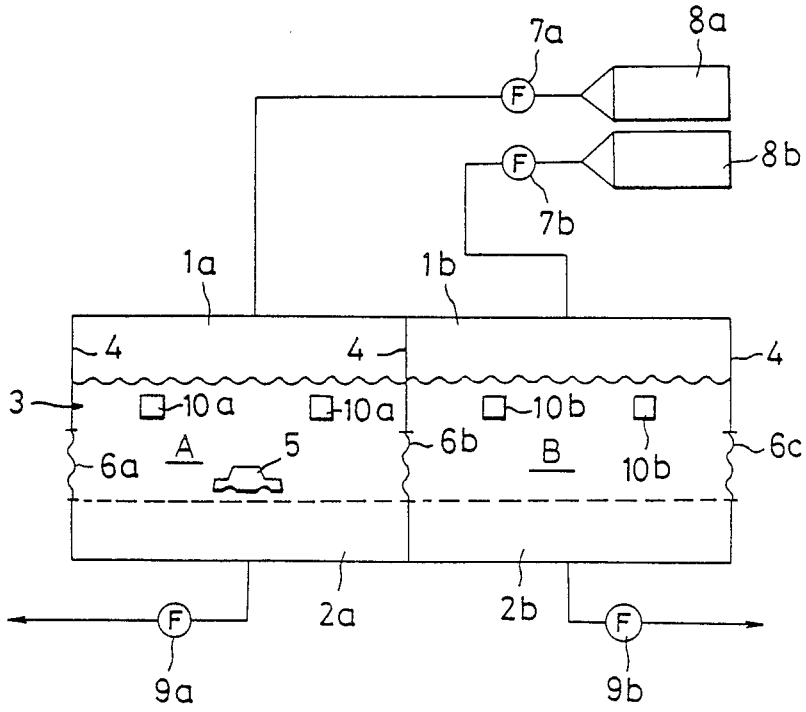
FIG.1 PRIOR ART
FIG. 1 is a typical drawing of prior art painting booth.
Figure 2:
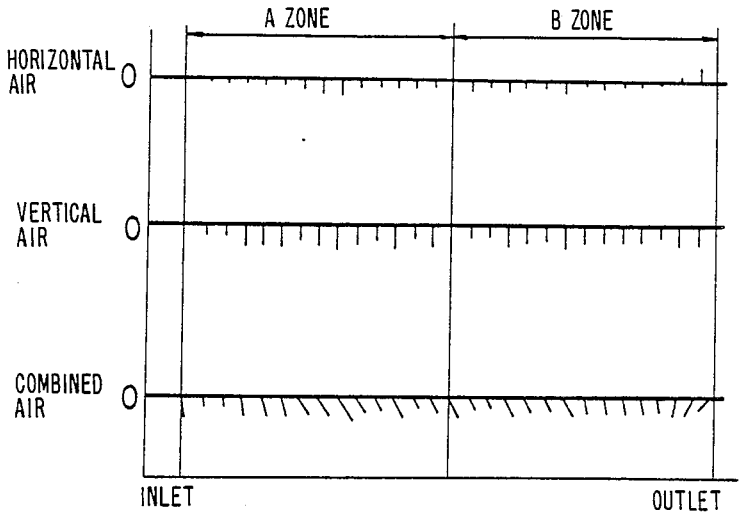
FIG. 2 PRIOR ART
FIG. 2 is an explanatory drawing showing a state of air currents in the prior art painting booth.
Figure 3:
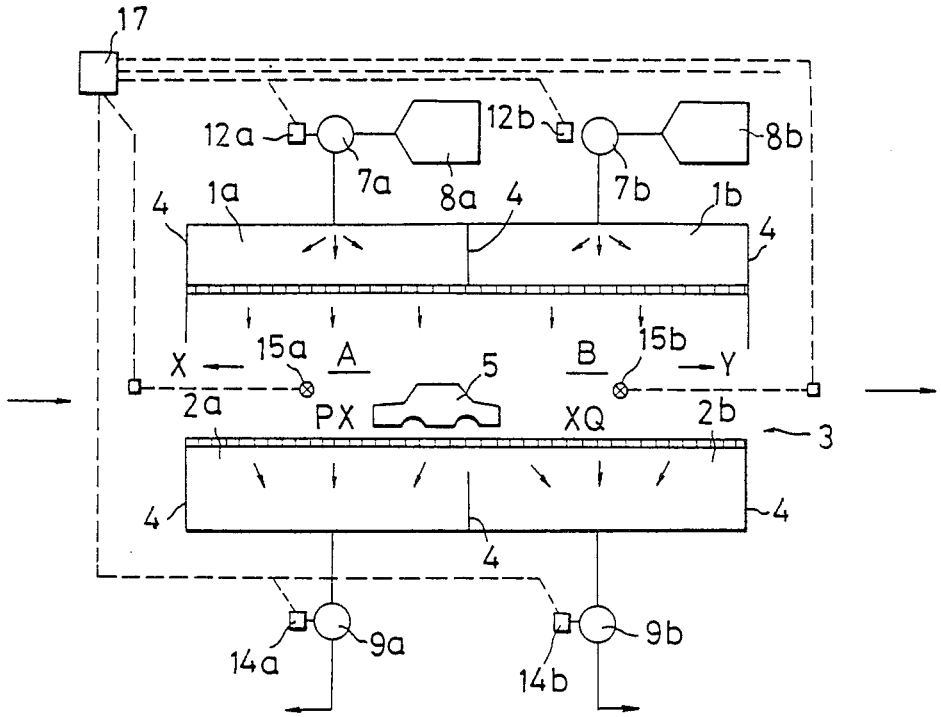
FIG. 3 is a typical drawing representing one example of a painting booth which is an object of the invention.

Preferred embodiments of the invention will now be described with reference to the accompanying drawings. FIG. 3 illustrates a painting booth operated according to a controlling method for operation of a painting booth of the invention, and first the construction will be described. The painting booth has the same construction as a prior art one already described with reference to FIG. 1, and like parts given therein are identified by the same reference character, thereby omitting a detailed description thereof. Air inlet chambers 1*a*, 1*b* divided by dividers 4 are positioned on an upper portion of the painting chamber 3 shown in FIG. 1. blast fans 7*a*, 7*b* are connected to the air inlet chambers 1*a*, 1*b* through ducts respectively, and well-known thermostats 8*a*, 8*b* are connected to the blast fans 7*a*, 7*b*. Blast fan controllers 12*a*, 12*b* are connected electrically to the blast fans 7*a*, 7*b* respectively for adjusting the feed air quantity and further connected electrically to a main controller 17 operating for centralized control. Exhaust chambers 2*a*, 2*b* divided half are positioned on a lower portion of the painting chamber 3, exhaust fans 9*a*, 9*b* are mounted to the exhaust chambers 2*a*, 2*b* through ducts respectively, further exhaust fan controllers 14*a*, 14*b* are mounted to the exhaust fans 9*a*, 9*b* respectively and connected electrically to the aforementioned main controller 17. The air inlet chambers 1*a*, 1*b* and the exhaust chambers 2*a*, 2*b* are spaced apart therebetween, the air inlet chambers 1*a*, 1*b* and the exhaust chambers 2*a*, 2*b* are formed opposite each other, and zones A, B are formed at every opposite spaces. Then, well-known air-speed sensors 15*a*, 15*b* are mounted at arbitrary positions longitudinal of zones A, B each, thereby detecting a speed of horizontal air current having an orienting property which is generated in the zones A, B. The air-speed sensors 15*a*, 15*b* are connected likewise electrically to the main controller 17, and thus feed air quantity and exhaust quantity at every zones A, B can be adjusted according to each detected value. A car body 5 which is an object to be painted passes through zones A, B in the painting chamber 3 of such construction as described to painting thereon, and painting in different colors is thus carried out continuously.

Described next is a controlling method for operation which is applied for the above-described painting booth.

Figure 4:
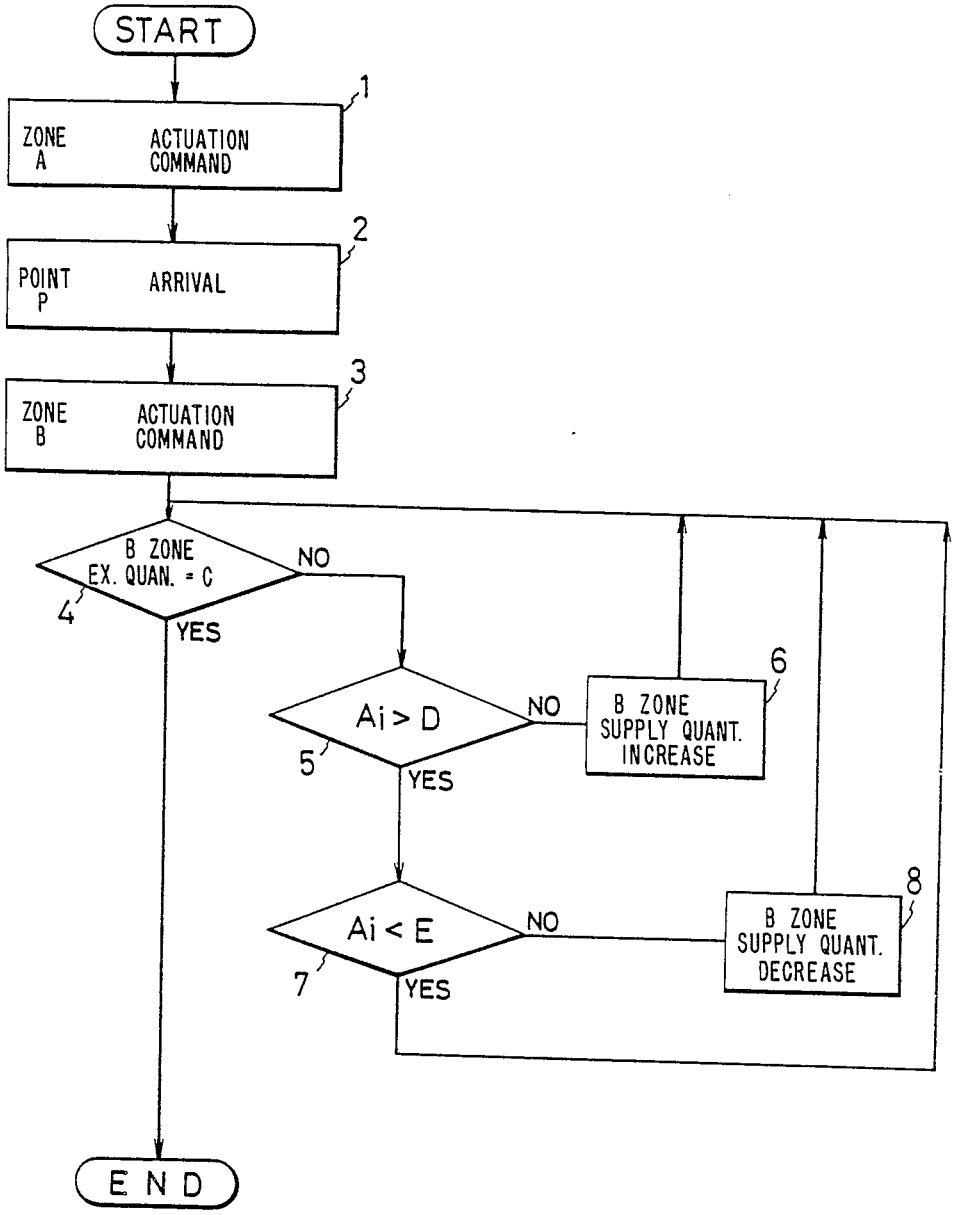
FIG. 4 and FIG. 5 are flowcharts of an operation control of the invention carried out with the painting booth shown in FIG. 3 as an object therefor.

For starting operation of the painting booth, first the blast fan controller 12*a* and the exhaust fan controller 14*a* are operated by the main controller 17 to actuate the blast fan 7*a* and the exhaust fan 9*a*, as shown in FIG. 4, before the first car body 5 arrives in the fore zone A ((1)). Then, the car body 5 is carried into the fore zone A and coated with a paint through a painting nozzle (not indicated). Further, when the car body 5 goes forward to arrive at an arbitrary point P in the fore zone A ((2)), the blast fan controller 12*b* and the exhaust fan controller 14*b* are operated by the main controller 17 to generate an actuation command to the blast fan 7*b* and the exhaust fan 9*b* ((3)). According to the aforementioned command, the exhaust fan 9*b* of the rear zone B is operated by the exhaust fan controller 14*b* to increase exhaust quantity at a preset acceleration. On the other hand, the blast fan 7*b* of the rear zone B is controlled by the blast fan controller 12*b* to stand by for operation. Then, exhaust quantity by the exhaust fan 9*b* gradually increases until it reaches a set point C ((4)). In this case, a part of the air current in the fore zone A is to move to the rear zone B, however, the air-speed sensor 15*a* in the fore zone A detects the speed of a horizontal air current in the zone, and when the detected air-speed value Ai in the direction indicated by an arrow Y in FIG. 3 is less than a predetermined value D ((5)), a feed air quantity by the blast fan 7*b* of the rear zone B is increased ((6)). That is, a necessary feed air quantity is increased within the limit not to allow the air current in the fore zone A to make the rear zone B generate a horizontal move. In case the feed air quantity by the blast fan 7*b* increases, and an air-speed value Ai' in the direction indicated by an arrow X in FIG. 3 which is detected by the air-speed sensor 15*a* of the fore zone A is greater than a predetermined value E ((7)). an air current of the rear zone B is capable of generating a horizontal move in the fore zone A, therefore feed air quantity by the blast fan 7*b* is decreased ((8)). Thus, a horizontal air current is prevented from arising in the fore zone A by adjusting the feed air quantity by the blast fan 7*b*. Then, when a rotational speed of the exhaust fan 9*b* increases and the exhaust quantity reaches the set point C, a feed air quantity by the blast fan 7*b* will be kept constant, and the operation for painting goes continuously.

Figure 5:
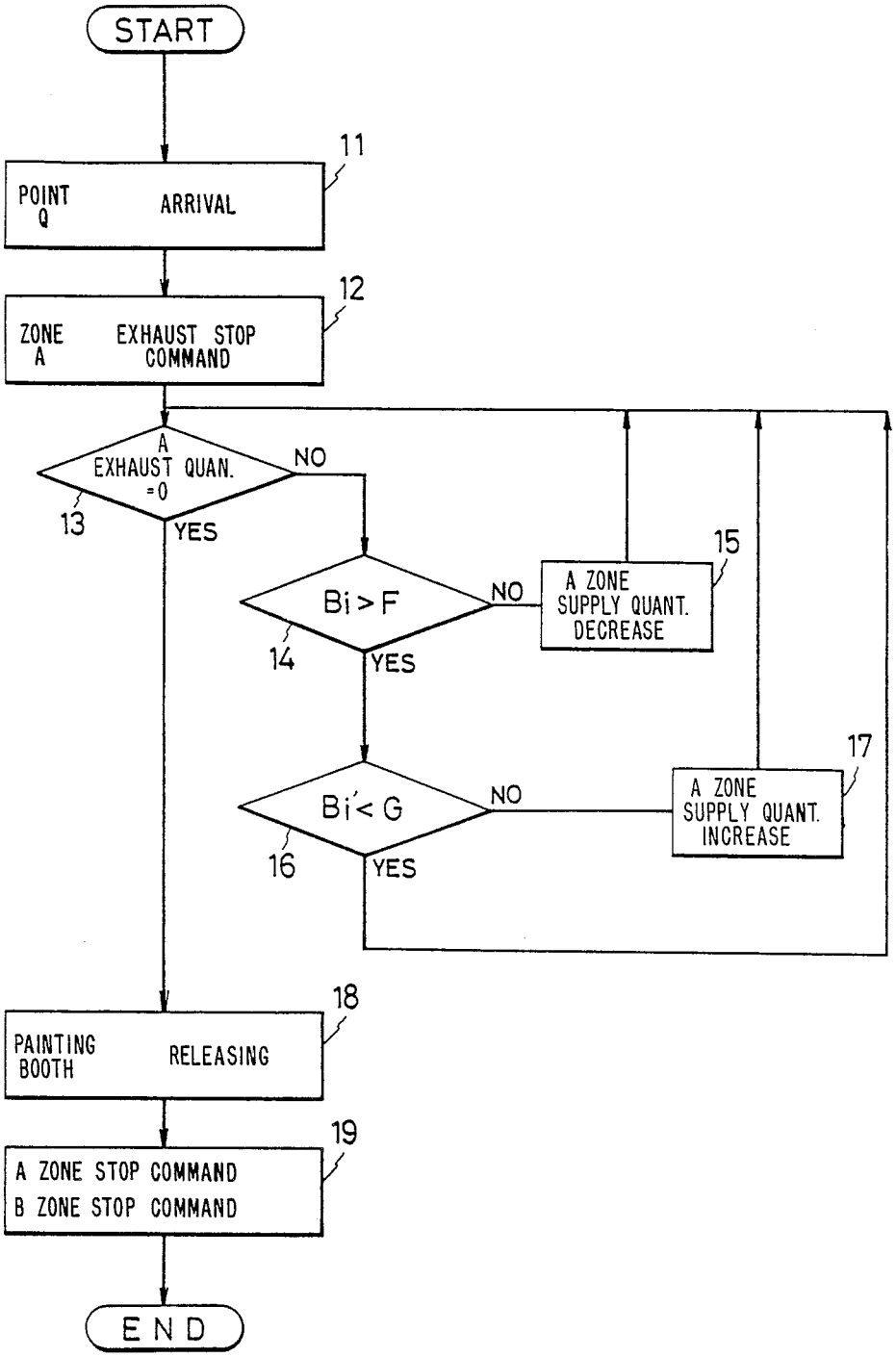

Described next is a process wherein the air current is stopped successively at every zones A, B with reference to FIG. 5. First, when the final car body 5 enters the rear zone B to painting in the line and reaches a point Q of the rear zone B ((11)), a stop command of the exhaust fan 9*a* is generated to the exhaust fan controller 14*a* by the main controller 17 ((12)), and the exhaust quantity is decreased on deceleration set beforehand to the exhaust fan controller 14*a*. Then, the rotational speed is stepped down until the exhaust quantity by the exhaust fan 9*a* is decreased to zero ((13)), however, the air speed is detected by the air-speed sensor 15*b* in the rear zone B in this case, and when an air-speed value Bi in the direction indicated by the arrow Y in FIG. 3 is less than F, the feed air quantity by the blast fan 7*a* is decreased ((15)). That is, the feed air quantity by the blast fan 7*a* is decreased within the limit not to generate a horizontal move of the air current in the rear zone B. If a detected air-speed value Bi' in the direction indicated by the arrow X in FIG. 3 is greater than G according to a decrease of the feed air quantity by the blast fan 7*a* ((16)), then the value is a critical one whereat the air current of the rear zone B is to make a horizontal move to the fore zone A, therefore the air current of the rear zone B will be forced back by increasing the feed air quantity by the blast fan 7*a*. Thus, a horizontal air current is prevented from arising in the rear zone B by adjusting the feed air quantity by the blast fan 7*a*. Then, when an exhaust quantity by the exhaust fan 9*a* is decreased to zero, the feed air quantity by the blast fan 7*a* will be kept constant, thereby carrying out painting in the rear zone B, and when the car body 5 comes out of the painting chamber 3 ((18)), the blast fan 7*a* and the exhaust fan 9*a* of the fore zone A and the blast fan 7*b* and the exhaust fan 9*b* of the rear zone B are shut down. Thus, the fore zone A can be actuated and then the rear zone B can be actuated, and on the other hand, the fore zone A can be shut down and then the rear zone Bcan be shut down. From what has been described, the fore zone A and the rear zone B can be actuated and shut down successively, therefore a wasteful operation of the fore zone A and the rear zone B can be avoided at the time of actuation and shutdown.

Figure 6:
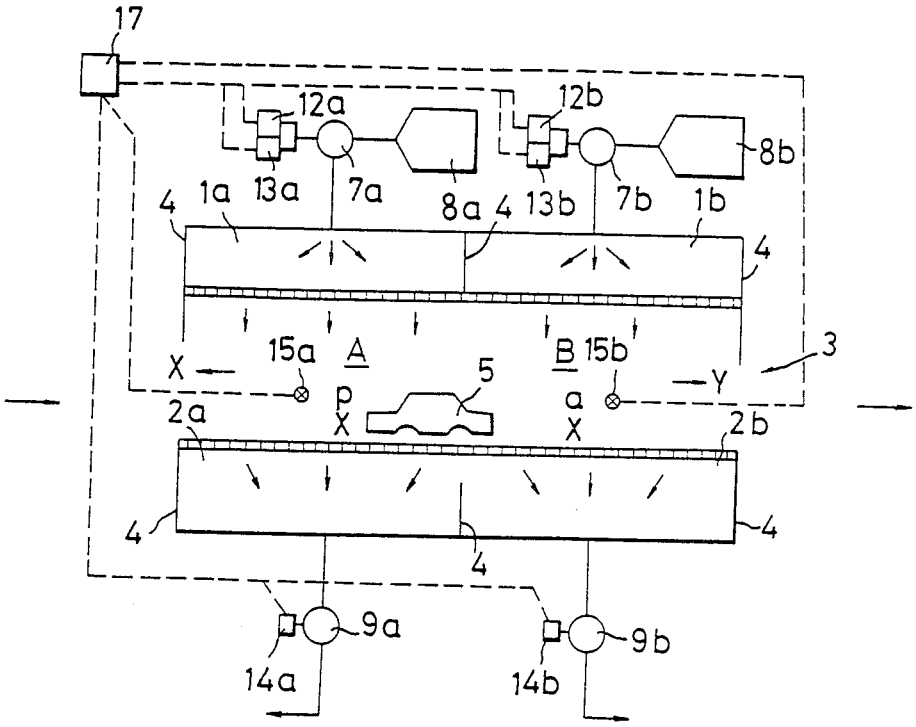
FIG. 6 is a typical drawing representing another example of the painting booth which is a object of the invention.

In the above-described embodiment, an arrangement is such that a rotational speed of the blast fans 7*a*, 7*b* is controlled by the blast fan controllers 12*a*, 12*b* for adjusting feed air quantity by the blast fans 7*a*, 7*b*, however, a variable acceleration may be controlled otherwise. In this case, feed air regulating speed controllers 13*a*, 13*b* are connected to the blast fans 7*a*, 7*b* respectively, as shown in FIG. 6, and a signal will be given thereto from the main controller 17. The feed air regulating speed controllers 13*a*, 13*b* are capable of controlling the blast quantity, namely speed for increasing or decreasing the feed air quantity by changing a blade angle of the blast fans 7*a*, 7*b*. For example, assuming that a reference time required for raising the feed air quantity from 0 to 100% is 100 seconds, it can be made fast at 80 seconds or slow at 120 seconds, and if, to the contrary, a reference time for lowering the feed air quantity from 100% to 0 be 60 seconds, then it can be made fast at 50 seconds or slow at 70 seconds.

Figure 7:
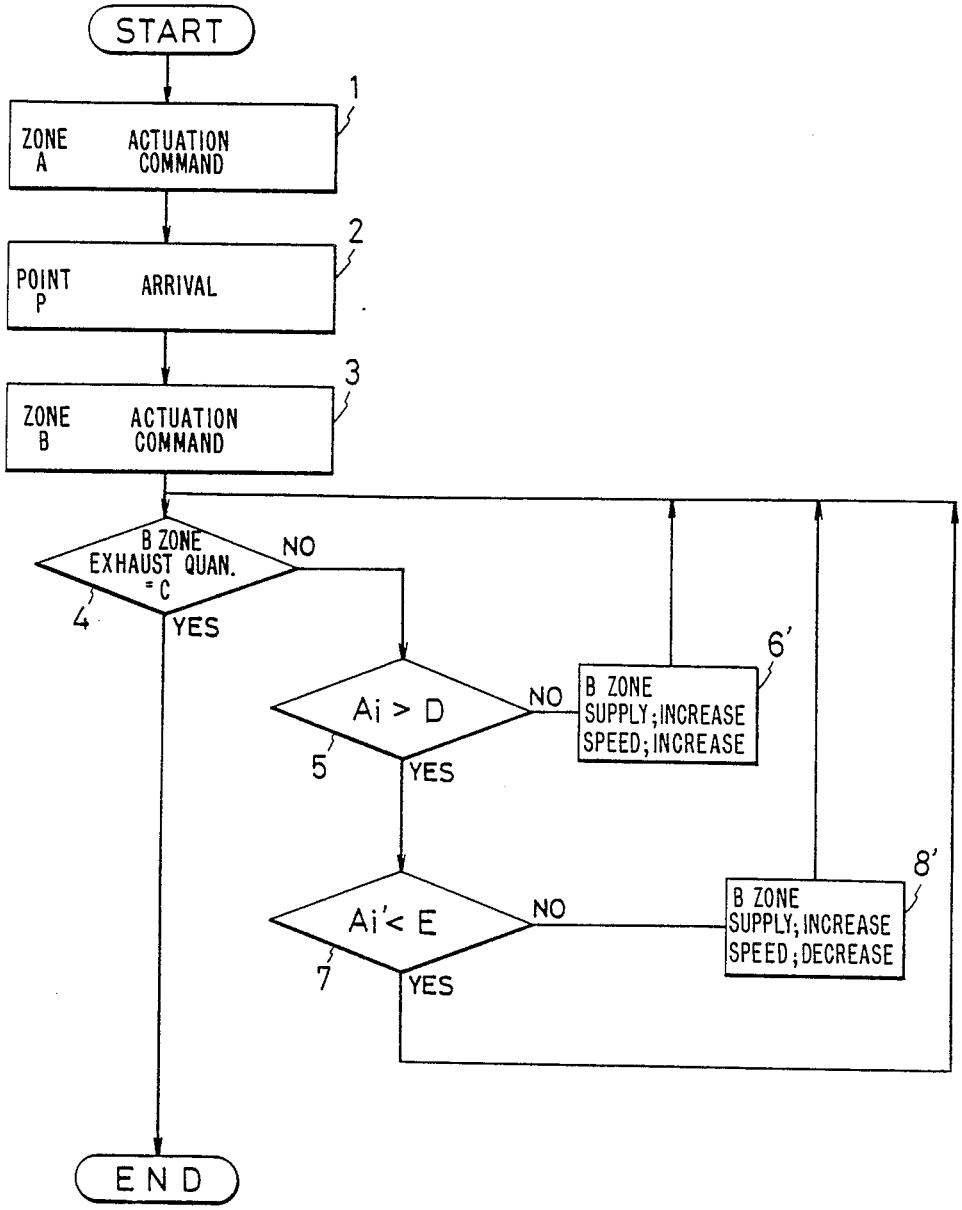
FIG. 7 and FIG. 8 are flowcharts of an operation control of the invention carried out with the painting booth shown in FIG. 6 as an object therefor.
Figure 8:
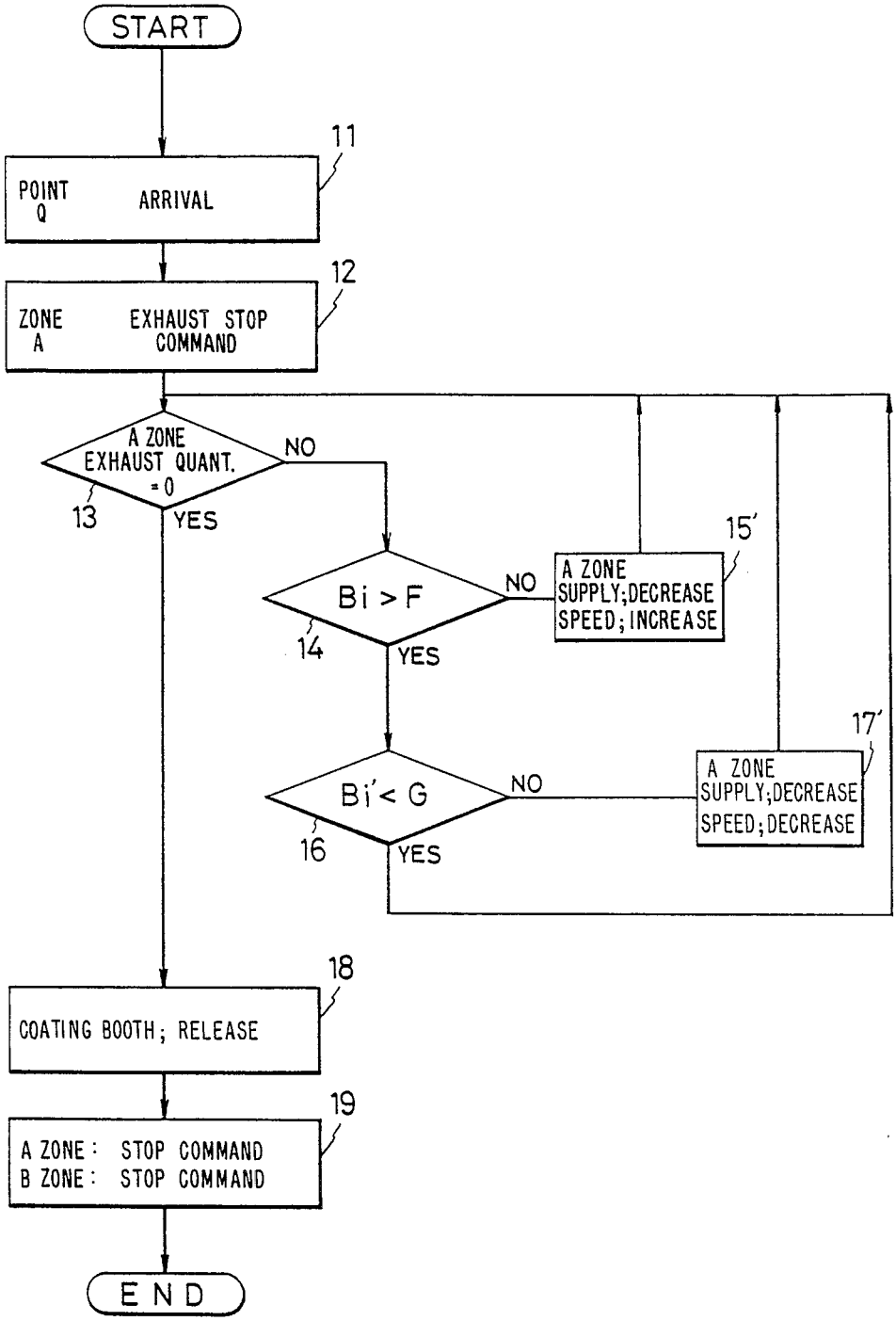

At the time of starting operation of the painting booth, if the air-speed value of a horizontal air current of the fore zone A is less than the predetermined value D in STEP (5) shown in FIG. 7, then the feed air regulating speed controller 13b of the rear zone B is actuated at STEP (6)' to raise the speed for increasing the feed air quantity, and the time for raising the feed air quantity is made fast. Then likewise, if the air-speed value Ai of a horizontal air current of the fore zone A is greater than the predetermined value E in STEP (7) shown in FIG. 7, the feed air regulating speed controller 13b is actuated at STEP (8)' to lower the speed for increasing the feed air quantity, and the time for lowering the feed air quantity is made slow. On the other hand, at the time of stopping operation of the painting booth, if the air-speed value Bi of a horizontal air current of the rear zone B is less than the predetermined value F in STEP (14) shown in FIG. 8, the feed air regulating speed controller 13a of the fore zone A is actuated at STEP (15)' to raise the speed for decreasing the feed air quantity, and the time for lowering the feed air quantity is made fast. Then likewise, if air-speed value Bi' of a horizontal air current of the rear zone B is greater than the predetermined value G in STEP (16) shown in FIG. 8, the feed air regulating speed controller 13a is actuated at STEP (17)' to lower the speed for decreasing the feed air quantity, and the time for lowering the feed air quantity is made slow. Thus, a response efficiency will be enhanced by controlling the speed for increasing or decreasing the feed air quantity, and a generation of horizontal air current which may deteriorate the paint quality can be suppressed more effectively. Then in FIG. 7 and FIG. 8, like reference characters represent like steps in foregoing FIG. 4 and FIG. 5, and a further description is omitted accordingly.

Figure 9:
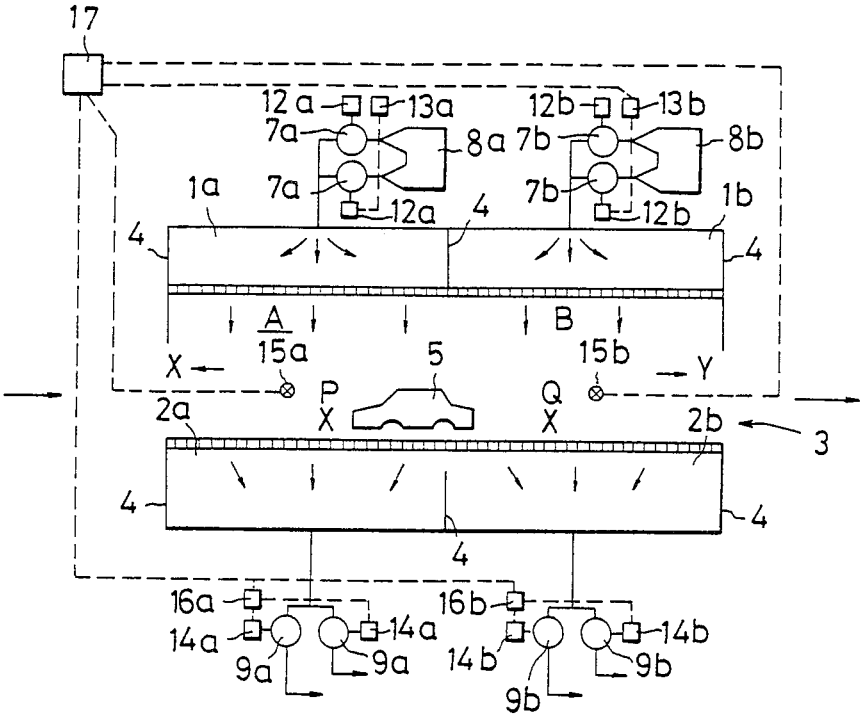
FIG. 9 is a typical drawing representing a further example of the painting booth which is an object of the invention.

Then particularly, there are some large-sized painting booths which are provided, as shown in FIG. 9, with a plurality of blast fans 7a, 7a and 7b, 7b or exhaust fans 14a, 14a and 14b, 14b at every zones. In case such painting booths are made objective, since each fan has a dispersion in capacity, it is difficult to obtain a desired value as combined air quantity from controlling the fans individually. Now, as shown in FIG. 9 likewise, the construction is improved such that the blast fan controllers 12a, 12a for the blast fans 7a, 7a corresponding to the fore zone A and the blast fan controllers 12b, 12b for the blast fans 7b, 7b corresponding to the rear zone B are connected to the aforementioned feed air regulating speed controllers 13a, 13b respectively, while the exhaust fan controllers 14a, 14a for the exhaust fans 9a, 9a corresponding to the fore zone A and the exhaust fan controllers 14b, 14b for the exhaust fans 9b, 9b corresponding to the rear zone B are connected to similar exhaust regulating speed controllers 16a, 16b respectively.

Figure 10:
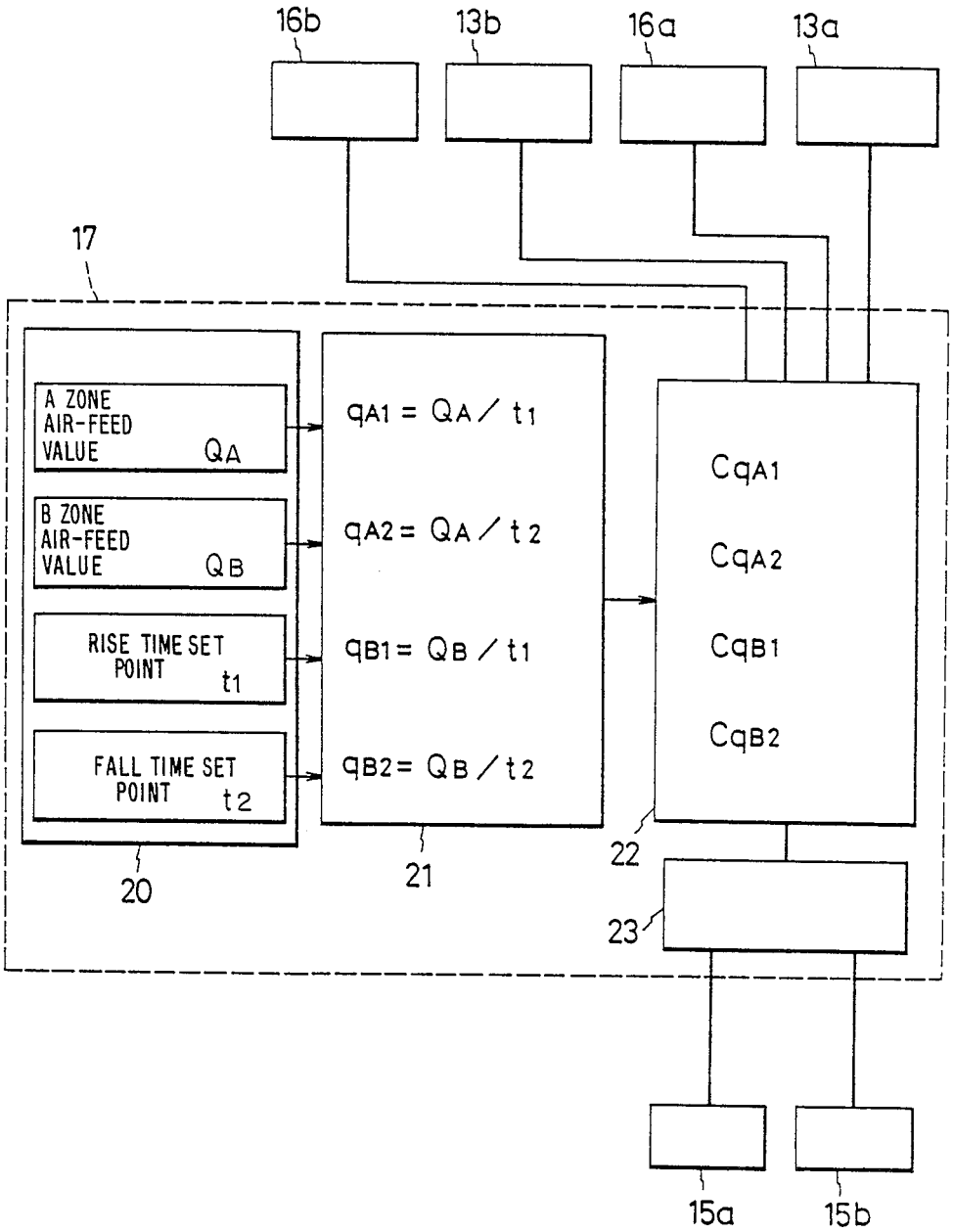
FIG. 10 is a block diagram showing a construction of a main controller in FIG. 9.

In this case, the main controller 17 consists, as shown in FIG. 10, principally of an input part 20, an arithmetic part 21 and a control part 22, the input part 20 comprising inputting an airflow set point $Q_A$ of the blast fans 7a, 7a and the exhaust fans 9a, 9a for the fore zone A, an airflow set point $Q_B$ of the blast fans 7b, 7b and the exhaust fans 9b, 9b for the rear zone B, a rise time set point $t_1$ at the time of actuation of the blast fans 7a, 7a and the blast fans 7b, 7b disposed in the fore zone A and the rear zone B respectively, and a fall time set point $t_2$ at the time of shutdown of the exhaust fans 9a, 9a and the exhaust fans 9b, 9b disposed in the fore zone A and the rear zone B respectively, through an input unit (not indicated). The arithmetic part 21 comprises computing the following values according to each value inputted to the input part 20:

Rise speed of the blast fans

7a, 7a and the exhaust fans: $q_{A1}=Q_A/t_1$ (1)

9a, 9a for the fore zone A

Fall speed of the blast fans

7a, 7a and the exhaust fans: $q_{A2}=Q_A/t_2$ (2)

9a, 9a for the fore zone A

Rise speed of the blast fans

7b, 7b and the exhaust fans: $q_{B1}=Q_B/t_1$ (3)

9b, 9b for the rear zone B

Fall speed of the blast fans

7b, 7b and the exhaust fans: $q_{B2}=Q_B/t_2$ (4)

9b, 9b for the rear zone B

The control part 22 gives a correction value C to the rise speeds $q_{A1}$, $q_{B1}$ of the blast fans 7a, 7a, 7b, 7b for the fore zone A and the rear zone B through an air speed detection circuit 23 according to signals coming from the air-speed sensors 15a, 15b for the fore zone A and the rear zone B. Accordingly, the feed air regulating speed controller 13a connected to the blast fans 7a, 7a for the fore zone A connected to the control part 22 at the time of actuation is controlled by a corrected rise speed of $Cq_{A1}$ from Eq. (1). Then, the exhaust regulating speed controller 16a connected to the exhaust fans 9a, 9a for the fore zone A is controlled by the rise speed which is not corrected by $q_{A1}$ from Eq. (1). Further, the feed air regulating speed controller 13b connected to the blast fans 7b, 7b for the rear zone B is controlled by the corrected rise speed of $Cq_{B1}$ from Eq. (3). The exhaust regulating speed controller 16b connected to the exhaust fans 9b, 9b is controlled by a rise speed not corrected by $q_{B1}$ from Eq. (3). On the other hand, the feed air regulating speed controller 13a connected to the blast fans 7a, 7a for the fore zone A at the time of shutdown is controlled by the corrected fall speed of $Cq_{A2}$ from Eq. (2). The exhaust regulating speed controller 16a connected to the exhaust fans 9a, 9a is controlled by a fall speed not corrected by $q_{A2}$ from Eq. (2). Then, the feed air regulating speed controller 13b connected to the blast fans 7b, 7b for the rear zone B is controlled by the corrected fall speed of $Cq_{B2}$ from Eq. (4), and the exhaust regulating speed controller 16b connected to the exhaust fans 9b, 9b is controlled by the fall speed $q_{B2}$ which is not corrected by Eq. (4).

In the painting booth constructed as above, the exhaust regulating speed controller 16b for the rear zone B is actuated at the time of starting in operation according to an actuation command in foregoing STEP (3) shown in FIG. 7, and an exhaust quantity is increased at the rise speed $q_{B1}$. Then, the feed air regulating speed controller 13b for the rear zone B is actuated in STEP (6)' of FIG. 7, thereby increasing a feed air quantity at the rise speed $Cq_{B1}$, and the feed air regulating speed controller 13b is actuated in STEP (8)' to increase the feed air quantity at the rise speed $q_{B1}$. On the other hand, the exhaust regulating speed controller 16a for the fore zone A is actuated at the time of stop of operation according to an exhaust stop command in foregoing STEP (12) shown in FIG. 8, thereby decreasing the exhaust quantity at the fall speed $q_{A2}$. Then in STEP (15)' of FIG. 8, the feed air regulating speed controller 13a for the fore zone A is actuated to decrease the feed air quantity at the fall speed $Cq_{A2}$, and in STEP (17)', the feed air regulating speed controller 13a is actuated to decrease the feed air quantity at the fall speed $q_{A2}$. Thus, in the large-sized painting booth provided with a plurality of blast and exhaust fans at every zones, operation goes for start-up and shutdown successively without generating a turbulent air current.

Figure 11:
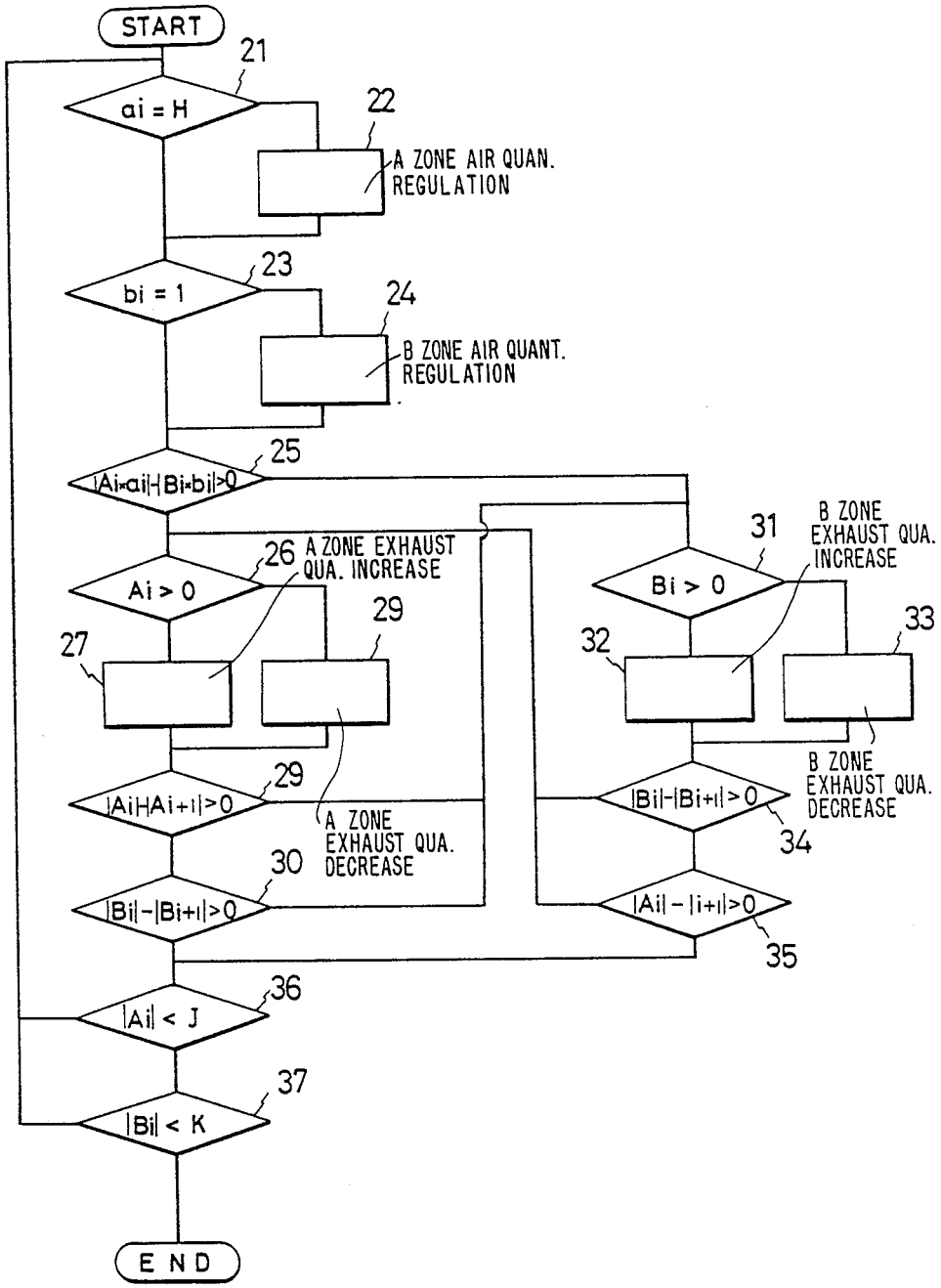
FIG. 11 is a flowchart of an operation control of the invention carried out with the painting booth shown in FIG. 3 as an object therefor.

Another embodiment of the controlling method at the time of steady operation will be described next with reference to FIG. 11. Then, the painting booth made objective in the embodiment is identical with that of having been shown in FIG. 3.

First, a vertical air-speed value ai in the zone A is measured on the air-speed sensor 15a ((21)), and if it is found missing a set point H, a signal is sent to the blast fan controller 12a for the zone A to control the blast fan 7a to ai=H ((22)). Next, a vertical air-speed value bi in the zone B is measured on the airspeed sensor 15b ((23)), and if it is found missing a set point I, then the blast fan 7b is controlled to bi=I ((24)).

The product of the vertical air-speed value ai and the horizontal air-speed value Ai of the zone A and the product of the vertical air-speed value bi and the horizontal air-speed value Bi of the zone B are then subjected to a comparison in absolute value ((25)), and in case the product of the zone A is greater than that of the zone B, first a sign (a direction of the wind is specified by plus or minus sign, the minus sign indicating the wind blowing toward centers of the zones A, B, the plus sign indicating the wind blowing toward a counter side thereto) of the horizontal air-speed value Ai of the zone A is decided ((26)), and if the sign is plus, a signal is sent to the exhaust fan controller 14a for the zone A to control the exhaust fan 9a so that an exhaust quantity will be increased by what has been set beforehand ((27)), but if minus, then it is controlled to decrease the exhaust quantity ((28)). Then, a horizontal air-speed value |Ai+1| of the zone A thereafter is measured on the air-speed sensor 15a, whether or not it is less than a measured value |Ai| before the control is decided ((29)), and if less, then whether or not a horizontal air-speed value |Bi+1| of the zone B after the control is less than a horizontal air-speed value |Bi| before the control is decided ((30)).

On the other hand, in case the product |Aiai| of the zone A is less than the product |Bibi| of the zone B in STEP (25), where the horizontal air-speed value |Ai+1| of the zone A after the control is not less than that of |Ai| before the control in STEP (29) and also where the horizontal air-speed value |Bi+1| is not less than that of Bi before the control, the controls are transferred to the zone B each. Then, a decision is made on whether the current horizontal air-speed value Bi obtained through the air-speed sensor 15b is plus or minus ((31)), thereby operating the exhaust fan 9b to acceleration ((32)) or deceleration ((33)), and thereafter a decision is made on whether the horizontal air-speed value |Bi+1| after the control is greater or less than that of |Bi| before the control ((34)) and also on whether |Ai+1| is greater or less than |Ai| ((35)) as in the case of controls of the zone A, and when |Bi+1| or |Ai+1| is not less, the controls are transferred each again to the zone A.

As described, controls are applied for adjusting the exhaust quantity gradually so as not to increase a horizontal air-speed value of the other zone, and the control is repeated from the start again until absolute values of the horizontal air-speed values Ai, Bi become less than set points J, K each ((36)). Thus, a mutual influence of each zone is suppressed, and an atmosphere in the painting chamber 3 can be kept stable.

We claim:

1. A method of controlling the operation of a painting booth having fore and rear painting zones with opposing air inlet and air exhaust chambers provided with corresponding blast and exhaust fan means, comprising the steps of:

generating a vertical air current between the air inlet and exhaust chambers of the fore and rear zones by operating the blast and exhaust fan means, at times when an object is to be painted in the corresponding zone;

detecting the speed of horizontal air currents in the fore and rear zone;

detecting the quantity of air exhausting from the fore and rear zones;

controlling the quantity of air entering the fore zone from the corresponding inlet chamber in accordance with the detected speed of the horizontal air currents in the rear zone;

increasing the quantity of air entering the rear zone in accordance with the detected speed of the horizontal air currents in the fore zone and decreasing the quantity of air exhausting from the fore zone for eliminating effectively horizontal air currents in the rear zone at times when an object to be painted, is in the fore zone;

feeding the air at a constant rate to the rear zone upon the detection of a predetermined quantity of air exhausting therefrom; and maintaining the quantity of the inlet air constant to the fore zone at times when the decreasing quantity of air exhausting from the fore zone reaches zero for terminating the air current in the fore zone.

2. The method of claim 1 wherein the quantity of entering air is controlled by adjusting the speed of a blast fan for increasing the inlet air quantity.

3. The method of claim 1, where the quantity of entering air is controlled by adjusting the speed of a blast fan for decreasing the inlet air quantity.

4. The method of claim 1, wherein the quantity of entering air is controlled by adjusting equally the speed of a plurality by blast fans for increasing the inlet air quantity.

5. The method of claim 1, wherein the quantity of entering air is controlled by adjusting equally the speed of a plurality of blast fans for decreasing the inlet air quantity.

6. A method for controlling the operation of a painting booth divided longitudinally into a plurality of painting zones wherein each zone has an air inlet chamber at an upper portion and an air exhaust chamber at a lower portion with each zone having independently driven air inlet and exhaust means, said method comprising:

detecting the air speed values of vertical and horizontal air currents in each of the painting zones;

selecting one of said plurality of zones for maximizing mixed flow of vertical and horizontal air currents and resulting wind direction in accordance with the detected air speed values;

controlling the air exhaust means of selected one of said plurality of zones for minimizing horizontal air flow; and controlling the air exhaust means of each adjacent one of the plurality of zones in succession until the detected values for the speed of the horizontal air current of each painting zone is less than a predetermined value.

7. A method of controlling the operation of a painting booth having fore and rear painting zones with opposing air inlet and air exhaust chambers, comprising the steps of:

generating a vertical air current between the air inlet and exhaust chambers of the fore and rear zones at times when an object is to be painted in said corresponding zone;

detecting the speed of horizontal air currents in the rear zone;

detecting the quantity of air exhausting from the fore zone;

decreasing the quantity of air exhausting from the fore zone at times when an object to be painted is in the rear zone;

controlling the quantity of air entering the fore zone from the corresponding inlet chamber in accordance with the detected speed of the horizontal air currents in the rear zone;

maintaining the quantity of the inlet air and constant to the fore zone at times when the decreasing quantity of air exhausting from the fore zone reaches zero for terminating the air current in the fore zone.

* * * * *